United States Patent [19]

Mercier et al.

[11] 4,376,316

[45] Mar. 15, 1983

[54] HINGE FOR ADJUSTABLE BEDS AND THE LIKE

[75] Inventors: Mark F. Mercier, Stevens Point; Frank M. Damico, Neenah, both of Wis.

[73] Assignee: Joerns Furniture Company, Stevens Point, Wis.

[21] Appl. No.: 221,795

[22] Filed: Dec. 31, 1980

[51] Int. Cl.[3] ..... A61G 7/00

[52] U.S. Cl. ..... 5/66; 5/69; 5/57 R

[58] Field of Search ..... 5/66-69, 5/57, 60, 63, 47, 48, 37-42; 16/366, 368

[56] References Cited

U.S. PATENT DOCUMENTS

| | | | |
|---|---|---|---|
| 782,335 | 2/1905 | Harvey | 5/67 |
| 1,030,936 | 7/1912 | Soss | 5/57 E |
| 1,070,525 | 8/1913 | Pieper . | |
| 1,617,108 | 2/1927 | Gursky | 5/67 |
| 1,701,588 | 2/1929 | Muller . | |
| 2,240,850 | 5/1941 | Knabusch et al. . | |
| 2,519,729 | 8/1950 | Alexander | 5/68 |
| 3,036,314 | 5/1962 | Wetzler . | |
| 3,069,200 | 12/1962 | Schliephacke . | |
| 3,115,363 | 12/1963 | Schliephacke . | |
| 3,174,161 | 3/1965 | Black | 5/68 |
| 3,216,026 | 11/1965 | Mann . | |
| 3,256,534 | 6/1966 | Benoit et al. . | |
| 3,278,952 | 10/1966 | Holm . | |
| 3,284,131 | 11/1966 | Fletcher . | |
| 3,530,514 | 9/1970 | McCalley . | |
| 3,581,319 | 6/1971 | Stanley et al. . | |
| 3,941,417 | 3/1976 | Re . | |
| 4,025,972 | 5/1977 | Adams et al. . | |
| 4,139,917 | 2/1979 | Fenwick . | |
| 4,156,512 | 5/1979 | Brown . | |
| 4,166,602 | 9/1979 | Nilsen et al. . | |

FOREIGN PATENT DOCUMENTS

| | | | |
|---|---|---|---|
| 810966 | 8/1951 | Fed. Rep. of Germany | 16/368 |

*Primary Examiner*—Francis K. Zugel
*Assistant Examiner*—Michael F. Trettel
*Attorney, Agent, or Firm*—Price, Heneveld, Huizenga & Cooper

[57] ABSTRACT

A hinge is provided for adjustable, hospital-type beds of the type having at least one articulated mattress support section. The hinge comprises two hinge plates, each having three pivot points thereon arranged in a triangular pattern. The upper ends of the hinge plates are attached to the bed frame and movable bed section respectively. The adjacent, lower pivot points of the two plates are rotatably interconnected, and the remaining pivot points are rotatably attached to a pair of links. The upper ends of the links connect their respective plate to that bed section opposite to the bed section the upper hinge plate end is attached to, whereby the movable bed section rotates about an imaginary axis above the mattress support to alleviate compression of that portion of the mattress positioned between the two bed sections when the movable bed section is raised.

27 Claims, 9 Drawing Figures

HINGE FOR ADJUSTABLE BEDS AND THE LIKE

BACKGROUND OF THE INVENTION

The present invention relates to adjustable, hospital-type beds, and in particular to a hinge therefor.

Adjustable beds, such as those disclosed in U.S. Pat. Nos. 3,919,727; 3,414,913; 3,281,872; and 3,281,873, which are hereby incorporated by reference, are used in hospitals, nursing homes, and other similar institutions, particularly for the care of nonambulatory patients. Such adjustable beds usually have a head section, a seat or center section, and a foot section, which are pivotally supported on a frame. The three bed sections are adjustable to provide patient comfort, as well as a wide range of therapeutic positions.

One problem experienced with such adjustable beds is that the mattress tends to bend and compress along the hinge axis of the bed when the bed sections are rotated from a flat to a raised position. This condition is particularly pronounced at the junction between the head and center sections of the bed. The bending action of the mattress tends to move or "walk" the mattress off of the support, and also causes the mattress to rub or abrade against the back of the reclined patient. Further, when the adjustable head section of the bed is raised to a sitting position, the mattress compression along the line or axis of the hinges produces a very hard or non-compliant support surface at the lower back area of the patient. The extent or degree of mattress compression is exacerbated as the thickness of the mattress arrangement is increased, because the upper surface of the mattress moves further away from the hinge point of the adjustable bed. Hence, the use of a separate box spring foundation and an overlying mattress for articulated beds has not been achieved with full success, even though such mattress arrangements are quite comfortable and therefore advantageous. In summary, mattress compression in adjustable, hospital-type beds tends to move the mattress from its proper position, rub against the patient's back, ruin the compliance of the mattress at a very critical support area for the patient, and contribute to the development of bed sores, muscular strain, and other deleterious effects which can result in severe patient discomfort.

Another problem associated with articulated hospital-type beds is the safety hazard created by the moving mattress support sections of the bed. It is therefore quite important to locate the hinges, and other moving mechanisms of the bed at a position where the patient will not be able to get his fingers or other appendages inadvertently pinched between the moving parts of the bed.

SUMMARY OF THE INVENTION

One aspect of the present invention is to provide a hinge for adjustable beds and the like, which will rotate adjacent bed sections about at an imaginary axis disposed above the support for the mattress, whereby that portion of the mattress positioned between the two bed sections will not be compressed when the bed is raised. The hinge also helps prevent the mattress from walking or shifting off of the supports. Preferably, the hinge is disposed wholly below the bed supports, so that the patient will not be able to get his fingers inadvertently positioned between any parts of the hinge mechanism. Further, the hinge is arranged so that it has a generally low profile, and can be located very close to the floor and still operate properly. The hinge is quite efficient in use, economical to manufacture, capable of a long operating life, and particularly well adapted for the proposed use.

These and other features, advantages, and objects of the present invention will be further understood and appreciated by those skilled in the art by reference to the following written specification, claims and appended drawings.

DETAILED DESCRIPTION OF THE PREFERRED EMBODIMENTS

Figure 3:
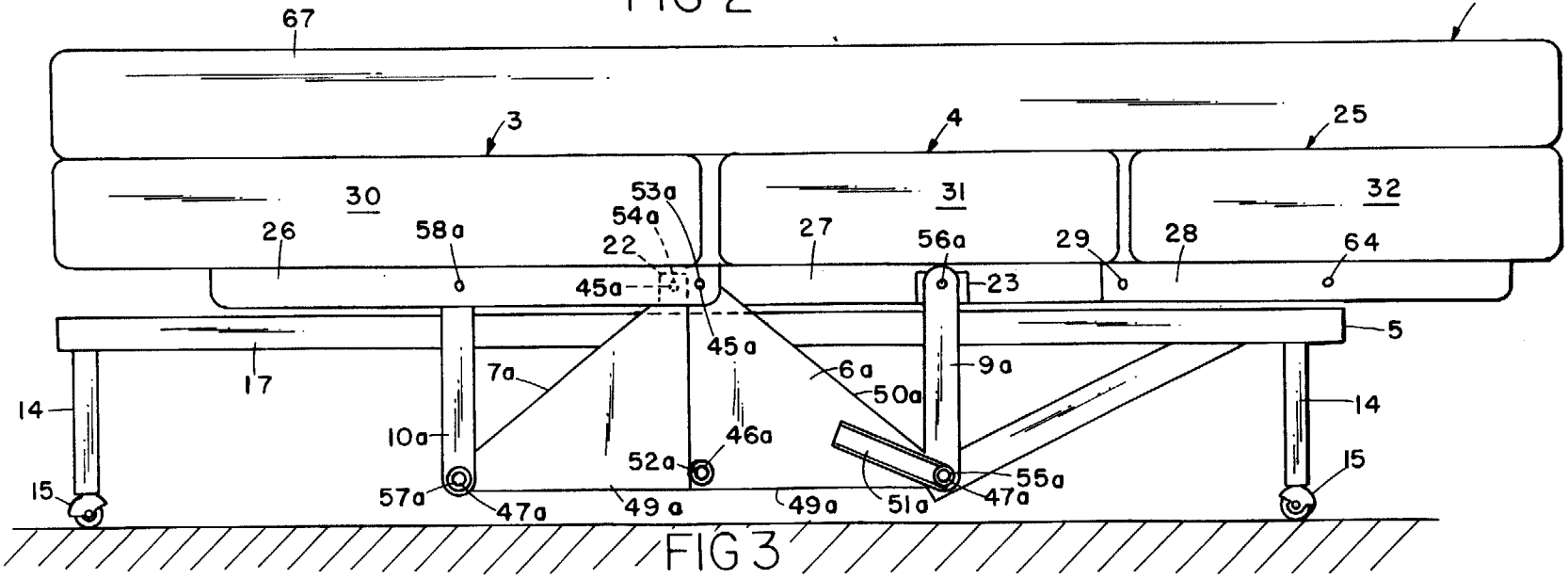
FIG. 3 is a side elevational view of the hinge, with the bed shown in a flat condition.

For purposes of description herein, the terms "upper", "lower", "right", "left", "rear", "front", "vertical", "horizontal", and derivatives thereof shall relate to the invention as oriented in FIG. 3. However, it is to be understood that the invention may assume various alternative orientations, except where expressly specified to the contrary.

The reference numeral 1 (FIG. 1) generally designates a hinge embodying the present invention, shown attached to an adjustable bed 2 of the type having at least one articulated mattress support section. In the illustrated example, four hinges 1*a*, 1*b*, 1*c* and 1*d* are used to pivotally interconnect a head section 3 and seat or center section 4 with the bed frame 5. Each hinge 1 comprises two hinge plates 6 and 7, with three pivot points 8 thereon arranged in a triangular pattern, and a pair of links 9 and 10 which pivotally interconnect the outer pivot points of the hinge plates 6 and 7 with the movable support section and frame of the bed.

The illustrated adjustable bed 2 (FIG. 1) includes four vertically disposed legs 14 which are rigidly attached to and depend from the corners of the frame 5, and securely support the frame above the ground. Casters 15 are attached to the lower ends of each leg 14 so that the bed may be easily transported from one location to another. Bed frame 5 is a generally rectangular structure, and includes side rails 16 and 17, and end rails 18 amd 19, each having an L-shaped transverse cross section. A pair of motor and jack screw assemblies 20 and 21 are mounted in frame 5, as described in greater detail hereinafter, and pivot the various moving portions of the bed. As best illustrated in FIGS. 2 and 3, bed frame 5 includes eight upstanding mounting brackets 22 and 23 which are rigidly attached to frame 5, and mount hinges 1*a*–1*d* to the bed frame. Mounting brackets 22 and 23 permit full and free rotation of the bed sections, while maintaining a low, overall profile.

The illustrated adjustable bed 2 (FIG. 1) includes three separate support sections, comprising head section 3, seat section 4, and a foot section 25. With reference to FIG. 3, the mattress supports comprise a first pair of rails 26 attached to head section 3, a second pair of rails 27 attached to center section 4, and a third pair of rails 28 attached to foot section 25. The foot section rails 28 overlap the adjacent ends of center section rails 27, and are pivotally interconnected thereto by means such as pins 29. As described in greater detail hereinafter, the illustrated foot section 25 articulates with center section 4. In this example, each bed section 2, 3 and 25 comprises a separate box spring foundation 30–32, having a flat, rigid back 33, constructed of wood or the like, on which the associated pair of support rails 26–28 are fastened along opposite sides of the back in a parallel relationship. Each of the rails 26–28 (FIG. 1) has a generally L-shaped transverse cross-sectional shape, with one of the flanges 34 fastened to the rigid back 33 of the respective bed section by suitable fasteners (not shown), and the other flange 35 depending therefrom along a vertical plane. With reference to FIG. 3, although gaps are shown between the adjacent ends of the box spring members 30–32, because hinge 1 rotates the mattress support sections 3 and 4 about an axis disposed above support rails 26 and 27, clearance between the ends of the box spring members is not necessary to the proper functioning of the bed.

Figure 1:
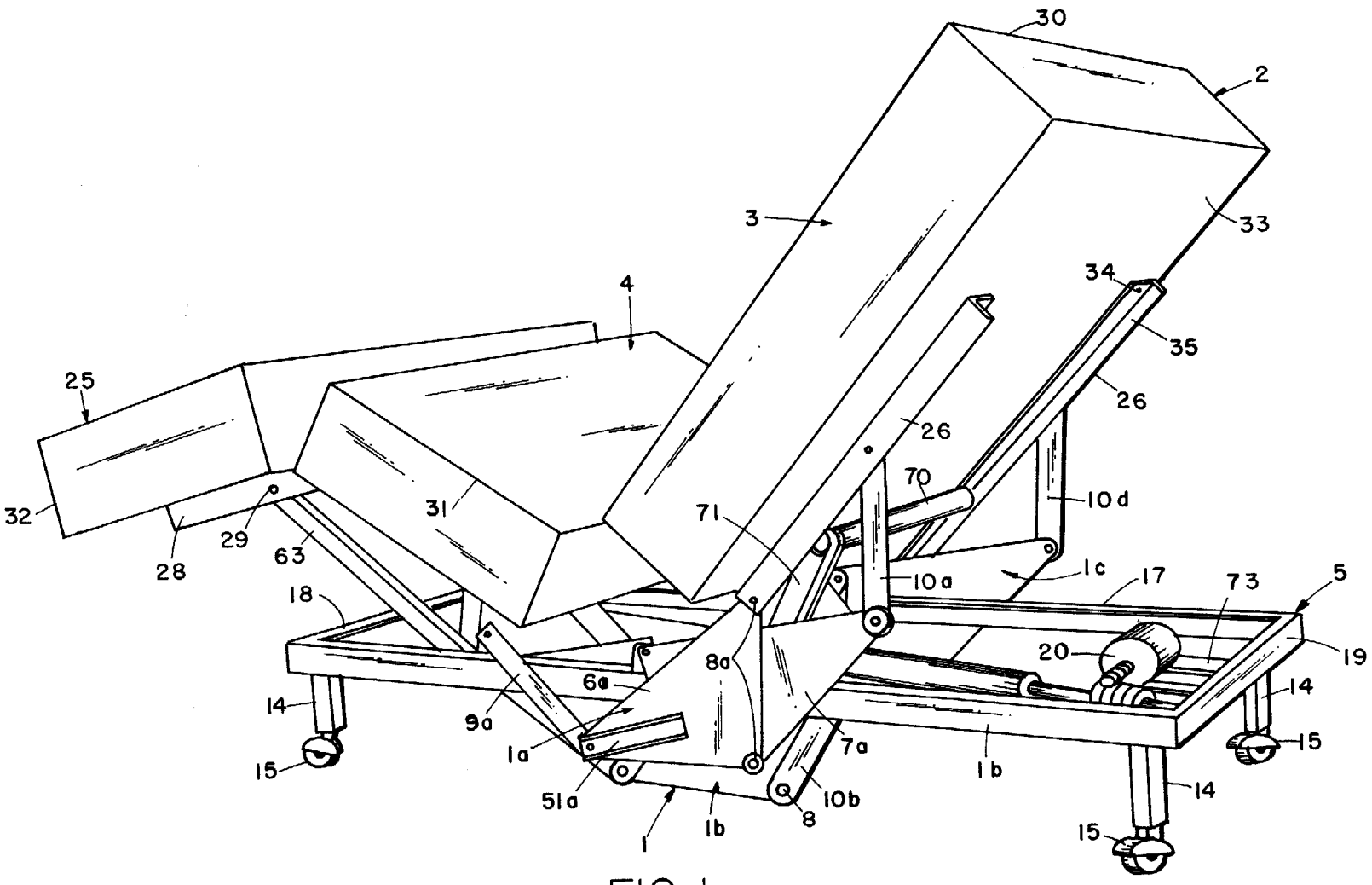
FIG. 1 is a perspective view of a hinge embodying the present invention, shown attached to an adjustable hospital-type bed, wherein a separate mattress portion thereof has been removed for illustrative purposes.
Figure 2:
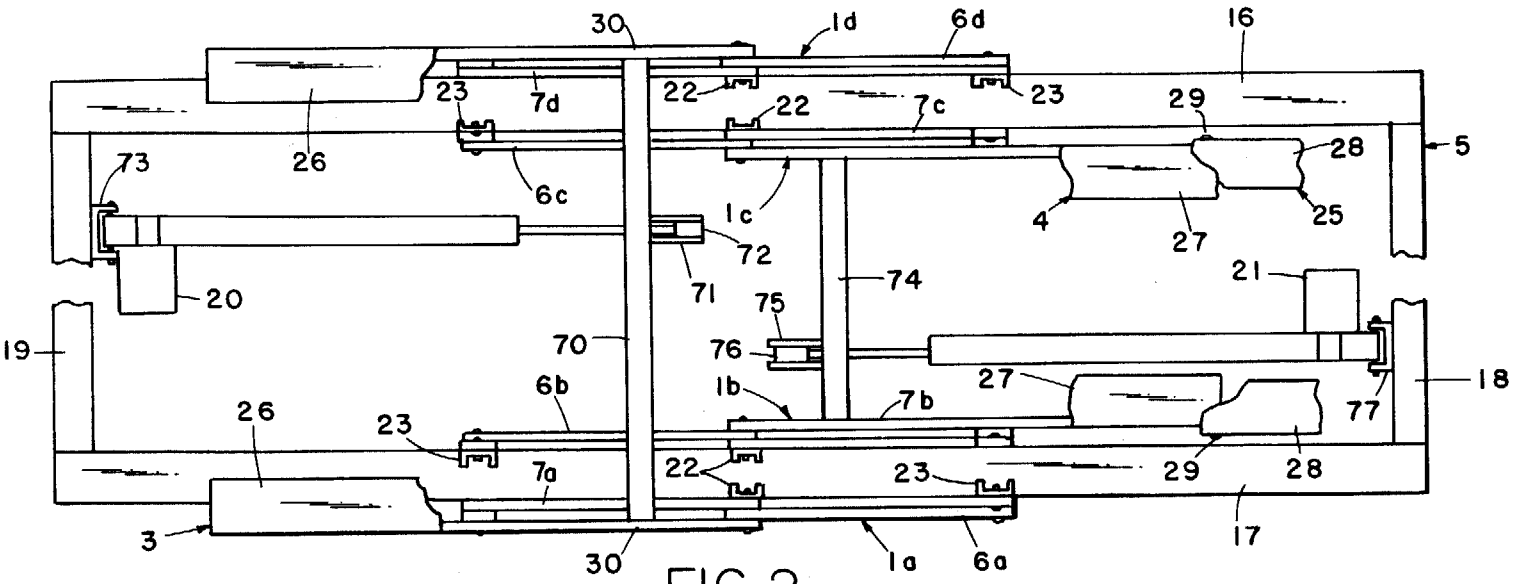
FIG. 2 is a fragmentary, top plan view of the bed, with four of said hinges attached to a frame portion of the bed.

In the bed illustrated in FIG. 1, both the head section 3 and seat section 4 of the bed are independently attached to bed frame 5 by two hinges 1*a* & 1*c* and 1*b* & 1*d* respectively. Hinges 1*a* & 1*c* attach head section 3 to the bed frame 5, and are disposed on the exterior side of frame rails 16 and 17. Hinges 1*b* & 1*d* connect the seat section 4 of the bed to bed frame 5 and are mounted on the interior side of frame rails 16 and 17. Since all of the hinges 1*a*–1*d* are substantially identical, similar parts appearing in each hinge are represented by the same, corresponding reference numeral, except for the suffixial designations "a", "b", "c", and "d", which indicate the specific hinge referenced. For ease of description, only hinge 1*a* will be described in detail, it being understood that hinges 1*b*–1*d* are structurally and functionally similar.

As best shown in FIG. 3, each hinge plate 6*a* and 7*a* includes three pivotal connection points 45*a*14 47*a*, arranged generally in a triangular pattern on the plate. The first pivot point 45*a* is positioned on plates 6*a* and 7*a* at a preselected location, whereby the plates are disposed generally below the mattress support rail to which it is connected. The second and third pivot points 46*a* and 47*a* are spaced apart from first pivot points 45*a*, as well as each other, and are located generally below first pivot point 45*a*. The third pivot point 47*a* is positioned on plate 6*a* and 7*a* at a location thereon spaced laterally from a straight, imaginary line connecting the first and second points 45*a* and 46*a* respectively.

In this example, hinge plates 6*a* and 7*a* (FIG. 3) have a generally right triangular configuration, with mutually perpendicular legs 48*a* and 49*a*, and a leg 50*a* extending along the hypotenuse of the plate. However, it is to be understood that plates 6*a* and 7*a* may comprise L-shaped arms, or have a configuration other than triangular, so long as pivot points 45*a*–47*a* are arranged in a triangular pattern thereon. The illustrated plates 6*a* and 7*a* are rigid and generally flat, with the corners somewhat rounded for safety and ease of operation. A U-shaped channel or bracket 51*a* is attached to hinge plate 6*a*, and extends from pivot point 47*a* inwardly along the plate at an angle to legs 49*a* and 50*a* and reinforces the plate against buckling under high loads. Hinge plate 6*c* also includes a similar reinforcing brace 51*c*. The pivotal connection points 45*a*–47*a* on the illustrated hinge plates are arranged thereon to define congruent right triangles, wherein the right angle of each of the triangles intersect to define pivot points 46*a*. The pivot points 45*a*–47*a* are preferably located adjacent a respective corner or vertex of the plates 6*a* and 7*a*. Hinge plates 6*a* and 7*a* are substantially identical in shape, and are rotatably interconnected at their respective pivot point 46*a* by means such as pin 52*a*. Pivot point 45*a* on outer plate 6*a* is pivotally attached to the head section support rail 26 by pin 53*a*, or other suitable means. The corresponding pivot point 45*a* of the inner plate 7*a* is attached to upstanding bracket 22 on bed frame 5 by a pin 54*a*. Pivot point 47*a* of outer hinge plate 6*a* is pivotally attached to the lower end of link 9*a* by pin 55*a*, and the upper link end is pivotally attached to frame bracket 23 by pin 56*a*. In like manner, the lower end of link 10*a* is attached to pivot point 47*a* of the inner hinge plate 7*a* by pin 57*a*, and the upper end of link 10*a* is pivotally attached to the head section support rail 26 by pin 58*a*.

The upper points of attachment 56*a* and 58*a* (FIG. 3) of links 9*a* and 10*a* are spaced laterally from attachment points 53*a* and 54*a*. In this example, the distance between pins 57*a* & 58*a* on link 10*a* and pins 55*a* & 56*a* on link 9*a* is substantially equal. Further, this distance is substantially equal to the distance between pins 52*a* and 53*a*. The distance between pins 58*a* & 54*a* is equal to the distance between pins 53*a* & 56*a*, and also substantially equal to the distance between pins 47*a* & 52*a*, and pins 52*a* & 55*a*. It is to be understood that this equilateral relationship is not required to achieve the novel hinge movement broadly contemplated herein. However, with this equilateral arrangement, the movable bed section, either head section 3 or center section 4, will pivot about an imaginary axis which is stationary. Otherwise, the imaginary axis will "float" or move along a generally arcuate line defining a locus of axes. Further, in the equilateral embodiment illustrated, it has been found that the imaginary pivot axis of the hinge is located directly above pins 53*a* and 54*a* a distance equal to the distance between pins 52*a* & 53*a*. In this embodiment, when the bed is in a flat or coplanar condition, the hypotenuse sides 50*a* of plates 6*a* and 7*a* and legs 49*a* thereof form an isosceles triangle, with links 9*a* and 10*a* disposed in a generally rectangular relationship with rails 26–27 and plate legs 49*a*. The distance between pins 52*a* & 57*a* and 52*a* & 55*a* does not have to be equal to achieve either the equilateral embodiment, or proper pivoting action.

Hinge 1*d* (FIG. 2) connects the support rails 26 on the opposite side of the bed with frame rail 16 in precisely the same fashion as discussed above with respect to hinge 1*a*. Hinges 1*a* and 1*d* operate as a pair on either side of bed frame 5 to pivotally mount the head section 3 and associated support rails 26, so that the head section will remain level from side-to-side as it is raised and lowered.

Figure 4:
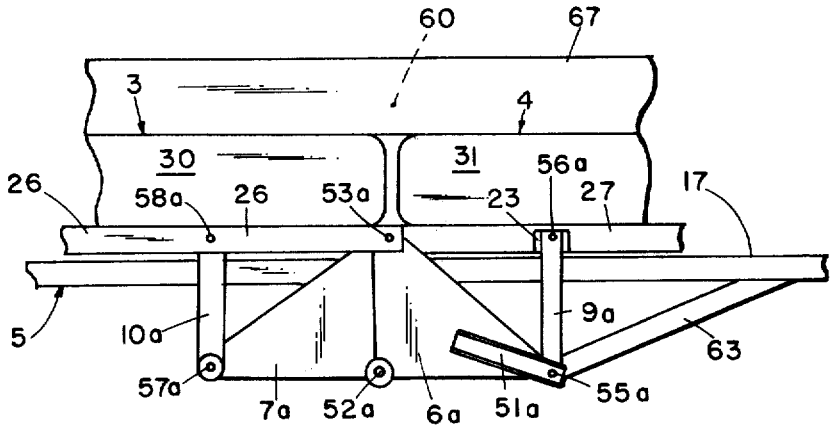
FIG. 4 is a side elevational view of the hinge attached to a fragmentary portion of the bed, which is shown in a flat condition.
Figure 5:
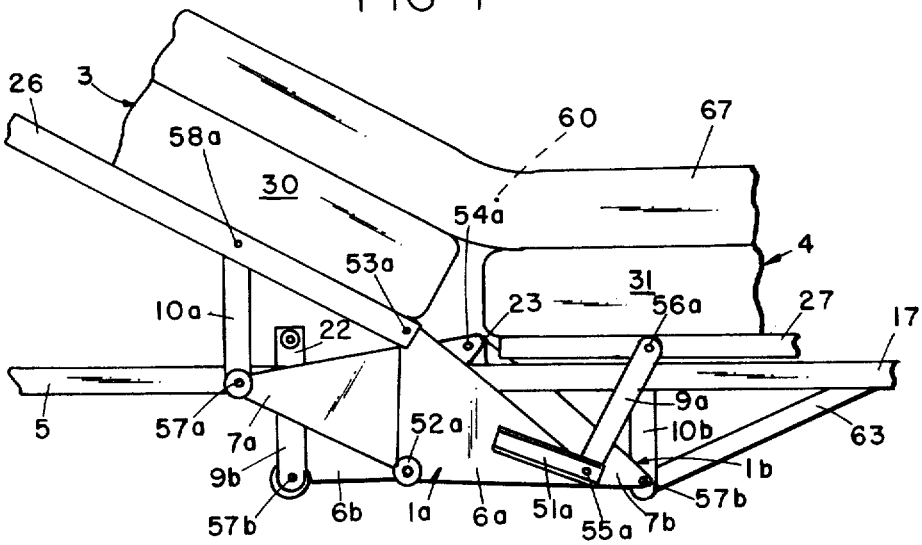
FIG. 5 is a side elevational view of the hinge which is substantially similar to FIG. 4, except that the left-hand bed section is shown in a slightly raised position.
Figure 6:
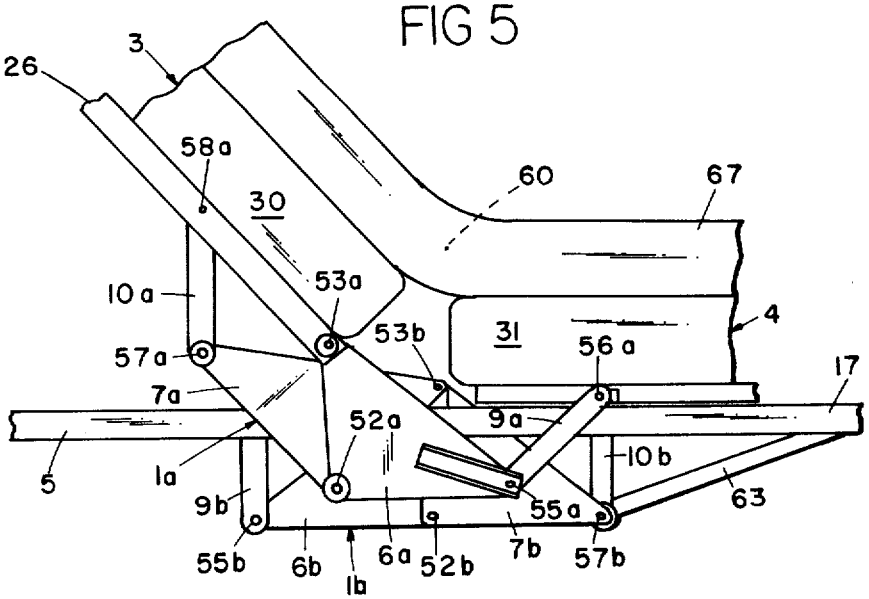
FIG. 6 is a side elevational view of the hinge which is substantially similar to FIGS. 4 and 5, except that the left-hand bed section is shown in a more fully raised position.

With reference to FIGS. 4–6, hinges 1*a* and 1*d* rotate head section 3 with respect to seat section 4 and frame 5 about an imaginary axis of rotation 60 disposed above the mattress support rails 26 and 27. Preferably, axis of rotation 60 is above the upper surface of box spring members 30 and 31, and in this example is positioned adjacent the center of mattress 67. When head section 3 is rotated (FIGS. 5 and 6), hinge plate 7*a* translates upwardly and rotates in a generally clockwise direction. Link 10*a* and exterior plate 6*a* also translate upwardly, but do not rotate, such that they remain in a substantially vertical orientation. Link 9*a* does not translate, but rotates in a clockwise direction an angular measure substantially equal to that through which plate 7*a* rotates. The above described movement of the links 9*a* & 10*a*, and plates 6*a* & 7*a* presents a double parallelogram pattern, with an adjacent corner of the parallelograms interconnected at pin 52*a*. Hinge 1*b*, which is located directly behind hinge 1*a* on the interior side of frame rail 17, remains stationary during the pivoting of head section 3, and moves only when seat section 4 is rotated.

Figure 7:
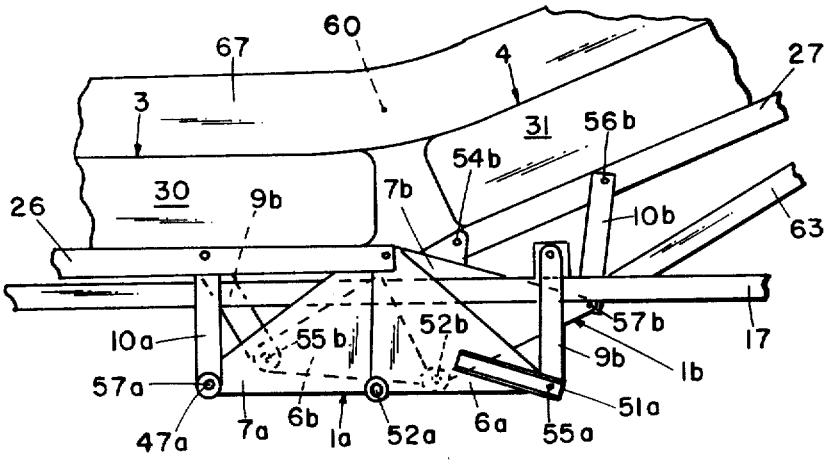
FIG. 7 is a side elevational view of the hinge, wherein the left-hand bed section is flat, and the right-hand bed section is disposed in a slightly raised position.
Figure 8:
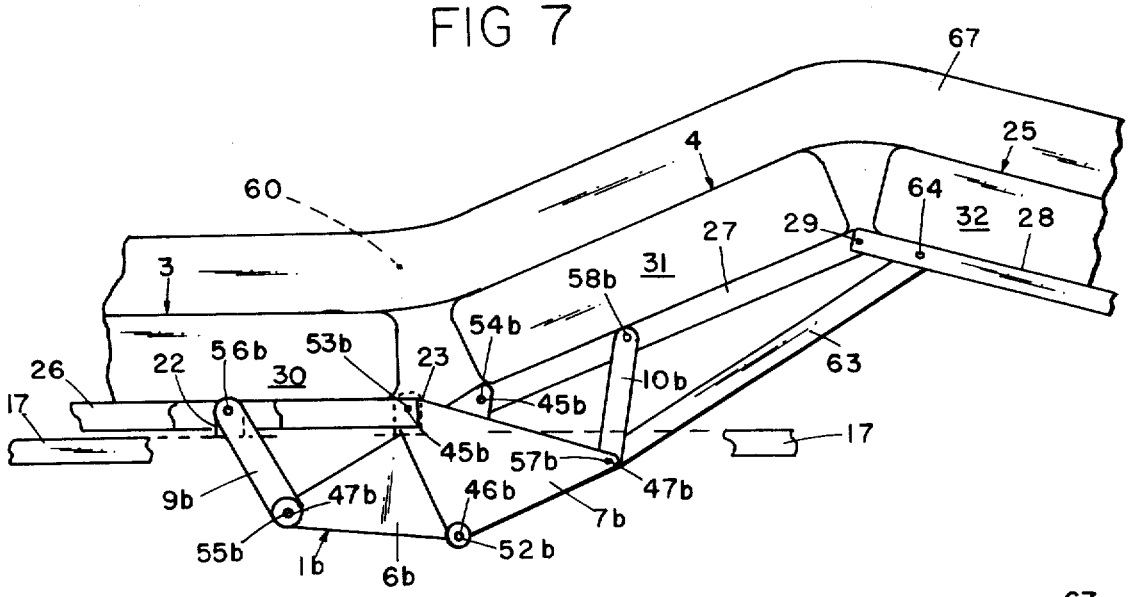
FIG. 8 is a side elevational view of the hinge, similar to FIG. 7, but wherein the frame has been broken away to more clearly reveal internal construction.
Figure 9:
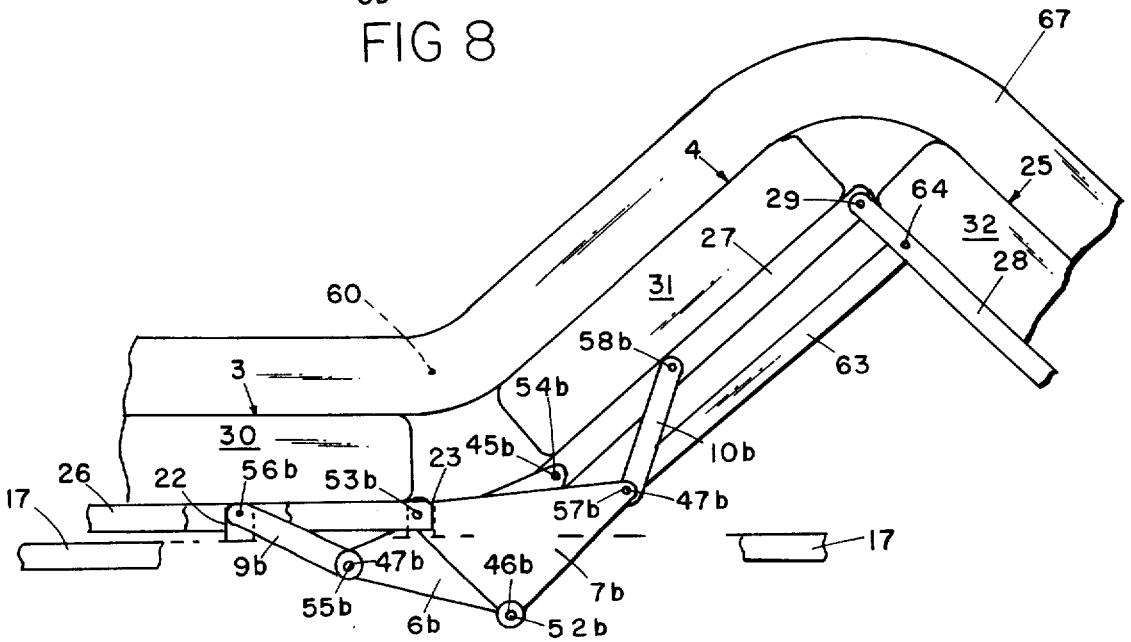
FIG. 9 is a side elevational view of the hinge, which is substantially similar to FIG. 8, except that the right-hand bed section is shown in a more fully raised position.

With reference to FIGS. 7–9, hinges 1*b* and 1*c* mount seat section 4 on bed frame 5 in a manner substantially identical with the manner in which hinges 1*a* and 1*d* attach head section 3 to the frame, as described above. The orientation of hinges 1*a* and 1*b* is reversed with respect to each other, with link 9*b* and plate 6*b* of hinge 1*b* positioned laterally beside link 10*a* and plate 7*a* of hinge 1*a*. On the right-hand side of the bed (with respect to a reclined user), hinge point 45*b* of plate 7*b* is connected with frame bracket 23 on the inside of frame rail 17 by pin 53*b*. The upper end of link 9*b* is attached to the other interior frame bracket 22 by pin 56*b*. Pivot point 47*b* of plate 6*b* is attached to the lower end of link 9*b* by pin 55*b*, and the upper pivot point 45*b* of plate 6*b* is attached to support rail 27 by pin 54*b*. Plates 6*b* and 7*b* are interconnected at their second pivot points 46*b* by pin 52*b*. The upper end of link 10*b* is attached to support rail 27 by pin 58*b*, and the lower end of link 10*b* is connected with pivot point 47*b* of plate 7*b* by pin 57*b*.

When seat section 4 is raised (FIGS. 8 and 9), plate 7*b* rotates in a counterclockwise direction, with link 10*b* and plate 6*b* remaining in a substantially vertical orientation, and being lifted upwardly. Link 9*b* rotates in a counterclockwise direction, an angular measure substantially equal to that of plate 7*b*, thereby forming another double parallelogram configuration.

A pair of foot section actuator links 63 (FIGS. 8 and 9) have one end pivotally attached to the foot section support rails 28 by pins 64, which are laterally spaced from pins 29. The other ends of links 63 are pivotally attached to pivot points 47*b* of hinges 1*b* and 1*c*, such that when seat section 4 is raised with respect to frame 5, foot section 25 is rotated downwardly with respect to the seat section into a comfortable, anatomically correct configuration.

With reference to FIG. 2, the head and seat sections 3 and 4 of the bed 2 are independently rotatable by the motor and jack screw assemblies 20 and 21. A tubular cross brace 70 extends laterally between the head section support rails 26, with the ends thereof fastened to depending flanges 30. A pair of crank arms 71 depend from cross brace 70 and form a clevis joint 72 in which the end of screw jack 70 is pivotally mounted. The other end of screw jack 20 is pivotally mounted to frame end rail 19 by bracket 73. A second tubular cross brace 74 extends laterally between the seat section support rails 27, with its ends fixedly attached to the depending flanges of the rails. Arms 75 are attached to cross brace 74 and form a clevis joint 76 in which the end of screw jack 21 is pivotally mounted. The outer end of screw jack 21 is pivotally attached to frame end rail 18 by bracket 77. Extension and retraction of screw jacks 20 and 21 applies a torque to the respective bed section, and rotates the same on hinges 1*a*–1*d*.

When either head section 3 or seat section 4 is raised with respect to frame 5, the corresponding hinge pair 1*a*–1*d* and 1*b*–1*c* pivots the respective bed section along the imaginary axis 60 disposed above the mattress support rails 26–28. As a result, the box spring members 30 and 31 will not be compressed as they are both below the line of imaginary hinge axis 60. Further, that portion of mattress 67 disposed between bed sections 3 and 4 tends to elongate slightly on the bottom half of the mattress and compress slightly on the upper half of the mattress. This slight compression is not enough to substantially effect the compliance of the mattress. Box spring members 30 and 31 can be designed to slide slightly under the lower surface of mattress 67, or otherwise designed so that the pivoting motion of the bed section does not substantially effect the compliance of the mattress. The positioning of imaginary axis 60 above the mattress supports also helps prevent the mattress from walking off of the supports. Since the hinges 1*a*–1*d* are located wholly below the mattress support sections, it is nearly impossible for a patient lying on the bed to inadvertently insert his fingers or other appendages into the hinge mechanism.

The hinge 1 provides an uncomplicated and secure means for interconnecting the articulated portions of an adjustable bed in a manner so that they rotate about an imaginary axis disposed above the mattress support and thereby avoid compressing the mattress along the hinge line when the bed is raised. Further, the shape of the hinge provides a very low profile construction, which is extremely safe.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or priviledge is claimed are defined as follows.

1. In an adjustable bed having a mattress, and first and second mutually articulated mattress support sections, the improvement of a hinge comprising:

a first plate pivotally connected with one of said mattress support sections at a first point on said plate; said first point being disposed on said first plate at a preselected location, whereby said plate is disposed generally below said one mattress support section; said first plate having second and third pivotal connection points, spaced apart from said first point and each other, and disposed generally below said first point; said third point being positioned on said plate at a location spaced laterally from a straight, imaginary line connecting said first and second points;

a second plate pivotally connected with the other one of said mattress support sections at a first point on said second plate; the first point of said second plate being disposed at a preselected location thereon, whereby said second plate is disposed generally below said other mattress support section; said second plate having second and third pivotal connection points, spaced apart from the first point of said second plate and each other, and disposed generally below said second plate first point; the third point of said second plate being positioned thereon at a location spaced laterally apart from a straight, imaginary line connecting the first and second points of said second plate;

a first link having one end thereof pivotally connected with said one mattress support section, and the other end pivotally connected with the third point of said second plate;

a second link having one end thereof pivotally connected with said other mattress support section, and the other end pivotally connected with the third point of said first plate; and means for pivotally interconnecting said first and second plates at said second pivotal connection points, whereby one of said mattress support sections is rotatable with respect to the other mattress support section about an axis of rotation disposed generally above said mattress support sections and adjacent to the center of said mattress to alleviate compressing that portion of said mattress disposed between said two mattress support sections.

2. A hinge as set forth in claim 1, wherein:

the distance between the ends of said first and second links is substantially the same.

3. A hinge as set forth in claim 1, wherein:

the distance between the first and second points on said first and second plates is substantially the same.

4. A hinge as set forth in claim 1, wherein:

the distance between said second and third points on said first and second plates is substantially the same.

5. A hinge as set forth in claim 1, wherein:

the distance between the first and third points on said first and second plates is substantially the same.

6. A hinge as set forth in claim 1, wherein:

the distance between the ends of said first and second links is substantially the same; and the distance between the first and second points on said first and second plates is substantially the same, and equal to the distance between the ends of said links, whereby said axis of rotation is substantially stationary, and positioned directly above said first pivot points a distance equal to the distance between said first and second pivot points.

7. A hinge as set forth in claim 1, wherein:

said first, second and third pivotal connection points on each of said plates define congruent right triangles, the right angle of each of said triangles defining said second points.

8. A hinge as set forth in claim 1, wherein:

said first and second plates each have a generally triangular shape, wherein said first, second and third pivotal connection points are disposed adjacent the corners of said plates.

9. A hinge as set forth in claim 1, wherein:

said first and second plates each have a right triangular shape with first and second legs disposed mutually perpendicular, and a third leg disposed along the hypotenuse of said plate;

said first pivotal connection point on each plate is disposed adjacent the corner formed by the intersection of said first and third legs;

said second pivotal connection point on each plate is disposed adjacent the corner formed by the intersection of said first and second legs; and said third pivotal connection points on each plate is disposed adjacent the corner formed by the intersection of said second and third legs.

10. In an adjustable bed having a mattress, a frame carrying a first mattress support thereon, and at least one additional, movable mattress support section rotatable with respect to said frame, the improvement of a hinge for connecting said movable support section with said frame; said hinge comprising:

a first plate pivotally connected with said movable support section at a first point on said plate; said first point being disposed on said first plate at a preselected location, whereby said plate is disposed generally below said movable support section; said first plate having second and third pivotal connection points, spaced apart from said first point and each other, and disposed generally below said first point; said third point being positioned on said plate at a location spaced laterally from a straight, imaginary line connecting said first and second points;

a second plate pivotally connected with said frame at a first point on said second plate; the first point of said second plate being disposed at a preselected location thereon, whereby said second plate is disposed generally below said frame; said second plate having second and third pivotal connection points, spaced apart from the first point of said second plate and each other, and disposed generally below said second plate first point; the third point of said second plate being positioned thereon at a location spaced laterally apart from a straight, imaginary line connecting the first and second points of said second plate;

a first link having one end thereof pivotally connected with said movable support section, and the other end pivotally connected with the third point of said second plate;

a second link having one end thereof pivotally connected with said frame, and the other end pivotally connected with the third point of said first plate; and means for pivotally interconnecting said first and second plates at said second pivotal connection points, whereby said movable mattress support section is rotatable with respect to said frame about an axis of rotation disposed generally above said first and movable support section and adjacent to the center of said mattress to alleviate compressing that portion of said mattress disposed between said movable and first mattress support sections.

11. An adjustable bed as set forth in claim 10, wherein:

said movable support section is attached to said frame by a pair of said hinges, disposed on opposite sides of said frame.

12. An adjustable bed as set forth in claim 11, wherein:

said first mattress support is pivotally connected with said frame by a second pair of said hinges.

13. An adjustable bed as set forth in claim 12, wherein:

said movable support section comprises a head section;

said first mattress support comprises a seat section; and said bed includes a foot section pivotally connected with said seat section.

14. An adjustable bed as set forth in claim 13, including:

a link having one end pivotally connected with said foot section, and the other end pivotally connected adjacent the third point of said second plate in said second hinge pair, whereby upward rotation of said seat section with respect to said frame automatically rotates said foot section downwardly with respect to said seat section to form an anatomical configuration.

15. An adjustable bed as set forth in claim 10, wherein:

said movable support section includes a lever attached rigidly thereto and extending laterally of said movable support section;

said bed includes a power ram having one end pivotally connected with said frame and the other end pivotally connected with said lever, whereby extension and retraction of said ram pivots said movable support section with respect to said frame.

16. An adjustable bed as set forth in claim 10, including:

a first box spring section supported on said first mattress support;

a second box spring section supported on said movable mattress support section; and said first and second box spring sections having upper surfaces on which said mattress is supported.

17. An adjustable bed as set forth in claim 16, wherein:

said mattress has a one-piece construction, and spans said first and second box spring sections.

18. An adjustable bed as set forth in claim 10, wherein:

the distance between the ends of said first and second links is substantially the same.

19. An adjustable bed as set forth in claim 10, wherein:

the distance between the first and second points on said first and second plates is substantially the same.

20. An adjustable bed as set forth in claim 10, wherein:

the distance between said second and third points on said first and second plates is substantially the same.

21. An adjustable bed as set forth in claim 10, wherein:

the distance between the first and third points on said first and second plates is substantially the same.

22. An adjustable bed as set forth in claim 10, wherein:

the distance between the ends of said first and second links is substantially the same; and the distance between the first and second points on said first and second plates is substantially the same, and equal to the distance between the ends of said links, whereby said axis of rotation is substantially stationary, and positioned directly above said first pivot points a distance equal to the distance between said first and second pivot points.

23. An adjustable bed as set forth in claim 10, wherein:

said first, second and third pivotal connection points on each of said plates define congruent right triangles, the right angle of each of said triangles defining said second points.

24. An adjustable bed as set forth in claim 10, wherein:

said first and second plates each have a generally triangular shape, wherein said first, second and third pivotal connection points are disposed adjacent the corners of said plates.

25. An adjustable bed as set forth in claim 10, wherein:

said first and second plates each have a right triangular shape with first and second legs disposed mutually perpendicular, and a third leg disposed along the hypotenuse of said plate;

said first pivotal connection point on each plate is disposed adjacent the corner formed by the intersection of said first and third legs;

said second pivotal connection point on each plate is disposed adjacent the corner formed by the intersection of said first and second legs; and said third pivotal connection points on each plate is disposed adjacent the corner formed by the intersection of said second and third legs.

26. A hinge for adjustable beds and the like having a mattress, and first and second mutually articulated mattress support sections; said hinge comprising:

a first plate adapted for pivotal connection with one of said bed sections at a first point on said plate; said first point being disposed on said first plate at a preselected location, whereby said plate is disposed generally below said one bed section; said first plate having second and third pivotal connection points spaced apart from said first point and each other, and disposed generally below said first point; said third point being positioned on said plate at a location spaced laterally from a straight, imaginary line connecting said first and second points;

a second plate adapted for pivotal connection with the other one of said bed sections at a first point on said second plate; the first point of said second plate being disposed at a preselected location thereon, whereby said second plate is disposed generally below said other bed section; said second plate having second and third pivotal connection points, spaced apart from the first point of said second plate and each other, and disposed generally below said second plate first point; the third point of said second plate being positioned thereon at a location spaced laterally apart from a straight, imaginary line connecting the first and second points of said second plate;

said first, second and third pivotal connection points on each of said plates defining congruent right triangles, the right angle of each of said triangles defining said second points;

a first link having one end thereof adapted for pivotal connection with said one bed section, and the other end pivotally connected with the third point of said second plate;

a second link having one end thereof adapted for pivotal connection with said other bed section, and the other end pivotally connected with the third point of said first plate;

means for pivotally interconnecting said first and second plates at said second pivotal connection points, whereby one of said mattress support sections is rotatable with respect to the other mattress support section about an axis of rotation disposed generally above the mattress support sections to alleviate compressing that portion of the mattress disposed between the two mattress support sections.

27. A hinge for adjustable beds and the like having a mattress, and first and second mutually articulated mattress support sections; said hinge comprising:

a first plate adapted for pivotal connection with one of said bed sections at a first point on said plate; said first point being disposed on said first plate at a preselected location, whereby said plate is disposed generally below said one bed section; said first plate having second and third pivotal connection points spaced apart from said first point and each other, and disposed generally below said first point; said third point being positioned on said plate at a location spaced laterally from a straight, imaginary line connecting said first and second points;

a second plate adapted for pivotal connection with the other one of said bed sections at a first point on said second plate; the first point of said second plate being disposed at a preselected location thereon, whereby said second plate is disposed generally below said other bed section; said second plate having second and third pivotal connection points, spaced apart from the first point of said second plate and each other, and disposed generally below said second plate first point; the third point of said second plate being positioned thereon at a location spaced laterally apart from a straight, imaginary line connecting the first and second points of said second plate;

a first link having one end thereof adapted for pivotal connection with said one bed section, and the other end pivotally connected with the third point of said second plate;

a second link having one end thereof adapted for pivotal connection with said other bed section, and the other end pivotally connected with the third point of said first plate;

means for pivotally interconnecting said first and second plates at said second pivotal connection points, whereby one of said mattress support sections is rotatable with respect to the other mattress support section about an axis of rotation disposed generally above the mattress support sections to alleviate compressing that portion of the mattress disposed between the two mattress support sections; and wherein said first and second plates each have a right triangular shape with first and second legs disposed mutually perpendicular, and a third leg disposed along the hypotenuse of said plate;

said first pivotal connection point on each plate is disposed adjacent the corner formed by the intersection of said first and third legs;

said second pivotal connection point on each plate is disposed adjacent the corner formed by the intersection of said first and second legs; and said third pivotal connection points on each plate is disposed adjacent the corner formed by the intersection of said second and third legs.

* * * * *